United States Patent [19]

Roy et al.

[11] Patent Number: 5,003,845

[45] Date of Patent: Apr. 2, 1991

[54] RADIATOR CAP REMOVER

[76] Inventors: James P. Roy, 5903 Mieras Rd.; James P. Harris, 1810 Birchfield Rd., both of Yakima, Wash. 98901

[21] Appl. No.: 250,938

[22] Filed: Sep. 29, 1988

[51] Int. Cl.[5] ..... B67B 7/18

[52] U.S. Cl. ..... 81/3.4; 81/3.09

[58] Field of Search ..... 81/3.07, 3.08, 3.09, 81/3.4, 3.43, 176.1, 176.15, 176.2, 124.2

[56] References Cited

U.S. PATENT DOCUMENTS 2,940,344 6/1960 Taylor, Sr. .
3,007,357 11/1961 Nalley ..... 81/176.1
3,048,067 8/1962 Miles et al. .
3,121,355 2/1964 Morel et al. .
3,253,485 5/1966 Grote .
3,481,227 12/1969 Shook .
4,357,845 11/1982 Cornia ..... 81/124.2
4,512,215 4/1985 Krauchick .

*Primary Examiner*—Roscoe V. Parker
*Attorney, Agent, or Firm*—Patrick Michael Dwyer

[57] ABSTRACT

An apparatus for removing a cap, especially a radiator cap, is disclosed having a cylindrical body 11, said body being open on one end, with diametrically opposed notch pairs 14 and 15 let into the walls of body 11 at its open end. A resilient strap 20 is employed to remove radiator caps which have no lugs. The invention will accommodate the removal of the majority of American and internationally made automotive radiator caps. Alternate embodiments are disclosed.

8 Claims, 1 Drawing Sheet

RADIATOR CAP REMOVER

TECHNICAL FIELD

This invention relates to the field of tools for removing caps, especially radiator caps, and more particularly to a tool for removing a hot radiator cap with reduced risk of burn hazard to a serviceperson.

BACKGROUND OF THE INVENTION

Most American and internationally made automobiles are powered by liquid cooled engines. The operating temperature of the liquid coolant can exceed the boiling point of water, and even when the operating temperature is below the boiling point of water the temperature of the coolant liquid is great enough to cause burn injuries to human flesh upon contact. Conventional liquid cooling systems are typically pressure closed systems such that as the temperature of the liquid coolant increases so does the pressure within the cooling system.

Consequently, there is considerable danger to an automotive serviceperson in removing the cap on the cooling system when the cooling system is at or near its operating temperature. Typically the cap is upon a forwardly placed radiator at a point in the engine compartment which is more or less within the reach of most servicepersons. The temptation during busy work periods to simply reach in and grasp the cap with no hand covering at all or with a slightly bunched rag is great, and yielding to that temptation frequently results in scald burns to the serviceperson from contact with either the liquid or the hot gases escaping under pressure at the instant that the seal of the cap is released. In addition, the radiator cap is often placed in tight surroundings and in close proximity to protruding flanges of various plastic and metal shrouding such that, aside from consideration of the burn hazard, a serviceperson's fingers are often cut in the process of removing and replacing the cap.

Accordingly there is a need for a compact, readily accessible and inexpensive tool which is always within reach of an automotive serviceperson so that the serviceperson will not be tempted to use bare hands or flimsy rags to remove a radiator cap. In addition a single tool should be able to accommodate most, if not all, of the radiator caps which the serviceperson will encounter in typical work situations. The removing tool should be durable and should allow the serviceperson to remove the cap without either touching it bare handed or getting fingers down where they can be cut. In addition the tool should tightly grip the radiator cap so that the serviceperson can control the direction of tilt of the cap at the instant it is loosened from the radiator so that the cap and the tool together form a gas and liquid spray shield to deflect hot gases and liquids away from the serviceperson harmlessly into the engine compartment. Finally the tool should serve to assist in reinstallation of the cap where there is still some burn hazard and the danger of cutting remains the same.

A number of devices are known for assisting the serviceperson in the removal of a hot radiator cap. One device is made of an easily compressible material which grips the cap in much the same fashion as the conventional mason jar lid opener grips the cap of a jar under the compressive force of the user's grip. Another device employs a rigid bell shaped housing with magnets for retaining the cap after it is removed. Other devices are known which are in appearance much like conventional socket wrenches. Most of the devices are designed for particular widths and shapes of radiator caps and do not approach universality of application. One device is known which employs an adjustable leaf spring to clamp different sized radiator caps and those without lugs.

None of the known devices disclose a simple and inexpensive tool for removing, with a single tool, the vast majority of American and internationally made radiator caps. Neither do they provide in their design a means to insure that the fingers of the serviceperson are not near burning or cutting hazards, yet at the same time providing a mechanical gripping surface which allows at least as much leverage to be applied to the cap as could be applied bare-handed. Neither do they provide a gripping and leverage means so designed as to permit the tool to be inserted into the modern crowded engine compartment without interference with shrouding, hoses or other engine compartment equipment.

DISCLOSURE OF THE INVENTION

Accordingly it is an object of the invention to provide a compact, readily accessible and inexpensive tool which is always within reach of an automotive serviceperson so that the serviceperson will not be tempted to use bare hands or flimsy rags to remove a radiator cap.

It is a further object of the invention to provide a simple and inexpensive tool for removing, with a single tool, the vast majority of American and international made radiator caps.

It is another object of the invention to provide a tool to ensure that the fingers of the serviceperson are not near burning or cutting hazards, yet at the same time providing a mechanical gripping surface which allows at least as much leverage to be applied to the cap as could be applied bare-handed.

It is another object of the invention to provide a tool to tightly grip the radiator cap so that the service person can control the direction of tilt of the cap at the instant it is loosened from the radiator so that the cap and the tool together form a gas and liquid spray shield to deflect hot gases and liquids away from the service person harmlessly into the engine compartment.

It is a further object of the invention to provide a tool to assist in reinstallation of the cap where there is still some burn hazard and the danger of cutting remains the same.

It is a still further object of the invention to provide a tool with a gripping and leverage means so designed as to permit the tool to be inserted into the modern crowded engine compartment without interference with shrouding, hoses, or other engine compartment equipment.

These and other objects of the invention which will become apparent in this description of the invention are accomplished as herein described. A section of pipe is employed as the body of the remover tool. This pipe can be either PVC or any other inexpensive, durable and fairly rigid material with an inner diameter which is larger than the diameter of the circular profile of most radiator caps but which is not larger than the diameter across the lugs of most radiator caps. In a preferred embodiment a PVC pipe is employed which has an inner diameter large enough to completely surround certain small internationally made caps, lugs and all.

One end of the section of pipe can be closed but the other end is left open. Alternatively some non-cylindrical shape could be employed as the body and the body could be made of some molded or worked substance, such as by injection molding or machining. The body need not be hollow, so long as there is a recess at one end of shape and volume large enough to receive the circular profile portion of a radiator cap.

Into the wall of the open end of the pipe or recess, are let two diametrically opposed notches. The notches can be ½", ¾", or 1 ⅜" wide depending upon the size of the radiator cap flanges or lugs in the caps to be removed. The notches are cut to a depth great enough to allow engagement with the lugs but not so great as to permit the remover body, when engaged down upon the lugs, to catch on a radiator overflow hose, if there is one. The notch widths can be sized to be a tight fit over the lugs so that when the cap is removed it remains in frictional engagement with the remover. However wider widths may be employed without departing from the scope of the invention. When the remover is fitted over the lugs it is pushed downward and turned counterclockwise to remove the radiator cap.

In a preferred embodiment the length of pipe is a length of PVC pipe of about 3" in length with an outer diameter of 2 ¾" and inner diameter of 2 ⅜". A 2" PVC cap is placed on one end for a more finished look in the product. In an alternate configuration two pairs of diametrically opposed notches, each set having different widths, are cut into the open end of the pipe. This increases the number of radiator caps which can be removed with a single device. It has been found in practice that two pairs of notches ½" and 1 ⅜" respectively, each pair angularly disposed at 90 degrees to one another, will accommodate the majority of known radiator caps.

To remove radiator caps which have no lugs, or small international caps which have lugs of a diameter which is less across the lugs than the inside diameter of the opening of the tool, an apparatus of the same general dimensions and characteristics as described above, but without the notches, is employed. It has however, a flexible strap, preferably of some rubber-type substance, pivotally attached at two diametrically opposing points on the exterior of the pipe. The strap can be attached at only one point on the exterior, not attached at all, but separate from the pipe, or rubber pads can be adhered to the inner walls of the recess, all without departing from the scope of our invention. There is sufficient slack in the strap, and the material has a thickness, such that when the removing tool is set down over a cap without flanges or a small international cap as above described, the cap is tightly wedged into the removing tool by compressing the rubber material against the interior walls of the tool. Once the tool with the flexible strap in place has been placed upon the cap it is used in same manner as the notched embodiment. It is necessary to allow only enough slack in the flexible strap to permit the removing tool to be inserted over a cap without requiring undue stretching of the strap material.

A preferred embodiment has a configuration employing both the two different sets of notches and the pivotally attached flexible strap in a single embodiment so that a single tool, readily available to the serviceperson, can handle virtually any known radiator cap.

In use, where it is ordinarily desirable to retain the radiator cap in engagement with the remover tool after the cap is removed, the flexible strap is pivoted across the opening and the tool is inserted onto the cap by slightly angling the tool to first contract one side of the cap, and then rocking the tool the rest of the way onto the cap against the frictional resistance of the strap. In this way, the cap will be retained even if the lugs are not an exact fit in the notches.

The device has a grip circumference convenient to the hands of most servicepersons so that no mechanical advantage is lost as it would be in twisting a handle of circumference less than the circumference of the average cap. The grip circumference should be at least as great as the circumference of the circular profile of the cap, while at the same time permitting the tool to be inserted down over a cap without interference with radiator overflow hoses or other kinds of sheet metal or plastic shrouding or other engine compartment equipment.

Whether or not the tool tightly grips the cap lugs, as soon as the cap is loosened it can be tilted so that hot coolant and steam are sprayed away from the serviceperson. Ordinarily, however, in a preferred embodiment, the radiator cap then remains snugly fitted in the end of the tool until the tool is used to replace the cap on the radiator.

BEST MODE FOR CARRYING OUT THE INVENTION

Figure 1:
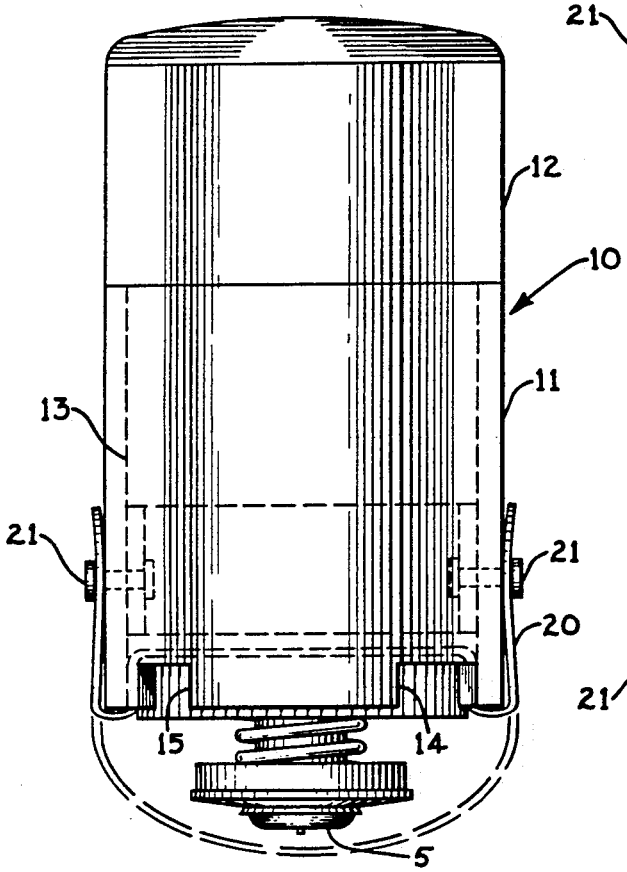
FIG. 1 is a side-elevational view of a preferred embodiment of the invention shown holding a lugless radiator cap (some interior details shown in hidden line; position of free-hanging flexible strap shown in phantom lines).
Figure 3:
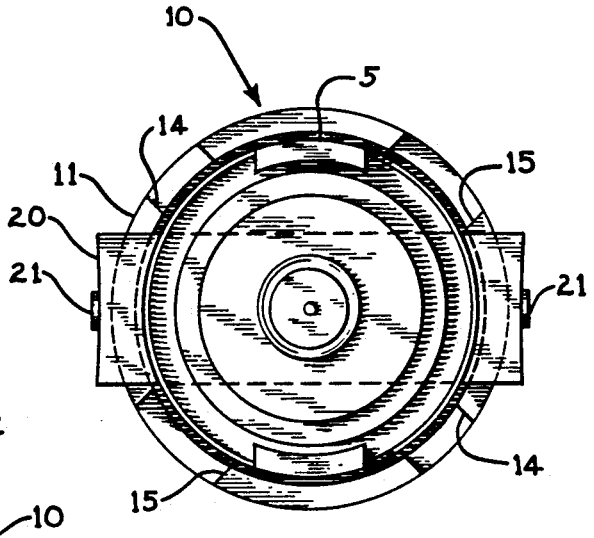
FIG. 3 is an end view of the embodiment shown in FIG. 1 with radiator cap engaged.

Referring now to the drawings wherein like numbers indicate like parts a preferred embodiment of the invention is described. In FIGS. 1 and 3 a radiator cap remover 10 is shown holding a radiator cap 5. This particular radiator cap 5 is the "lugless" type; that is, it has no projecting lugs, sometimes referred to as "ears", to assist the serviceperson's bare-handed grip upon the otherwise rounded circumference of the radiator cap. Such lugless type radiator caps are typically knurled or ribbed to increase gripability. The present invention however requires neither knurling nor ribbing on a lugless type radiator cap, as will be more fully described below. In addition, a preferred embodiment of the invention is fully capable of handling either the lugless type of radiator cap or a radiator cap with diametrically opposed lugs. Use of a preferred embodiment with lug-type radiator caps will be further discussed herein.

The apparatus of a preferred embodiment is comprised of a cylindrical remover body 11. In this embodiment body 11 is a 3" section of pipe open at both ends. The pipe may be of any material having generally rigid and durable characteristics. A polyvinylchloride (PVC) plastic pipe of the kind normally employed in plumbing and irrigation systems is preferred for its low-cost, ease of working during the manufacturing process, durability, light weight, and availability of standard sizes suitable for these automotive applications. However pipes of other material composition may be used without departing from the spirit of the invention. Again, for ease of manufacturing and light weight, the pipe is left substantially hollow. However, a standard PVC cap 12 is employed in a preferred embodiment to serve the function not only of closing the upper end of the pipe for appearance and ease of handling, but also to extend the height of the apparatus from 3" to approximately 5". In some applications the extra height of the apparatus will facilitate insertion of the apparatus into a difficultly located radiator cap position and the use of a height extending cap in this instance is therefore regarded as a part of the invention.

In the embodiment depicted in the drawings, a 3" section of PVC pipe with an outside diameter 2 ¾" and an inside diameter of 2 ⅜" is used because it is the standard size of PVC pipe most appropriate to this automotive application. Exact dimensions are not especially critical, however, as long as the inside diameter of the lower end of body 11 is greater than the outside diameter of the circular profile of standard radiator caps. This dimension also should accommodate most small international caps as described above. Similarly the 3" length chosen for body 11 in a preferred embodiment may be varied in other embodiments to suit the nature of the application, such as a necessity of reaching a more recessed radiator cap (requiring longer body 11 length) or a radiator cap positioning with limited overhead clearance (requiring a shorter body 11 length). For most applications however, the 3" length of body 11 in a preferred embodiment represents the best choice to accomplish one of the invention's principle purposes of providing a virtually universal radiator cap removing tool.

In the lower, or uncapped, end of body 11 are let in two pairs of notches, a pair of wide notches 14 and a pair of narrow notches 15. The wide notches 14 in a preferred embodiment are 1 ⅜" to fit over both the old standard Ford ¾" lugs and the older style caps with wide lugs and a pressure release lever. The narrow notches 15 are sized to fit over ½ lugs or smaller. When the wide and the narrow pairs of notches are offset by 90 degrees, the tool also fits over the newer Ford style double lugs. Notches 14 are diametrically opposed from one another as are notches 15, and each pair of notches is angularly offset from the other in this embodiment by 90 degrees from the center line of the respective notches. Other degrees of angular offset however may be employed provided the notch pairs remain distinct from one another and provided that the newer Ford style caps are not to be included in the application of the tool. The notch depths in a preferred embodiment are between ⅜" and 7/16" so that the lower edge of body 11 will not interfere or hang up on the commonly present radiator overflow hose normally located just below the lower edge of the circular portion of the standard radiator cap.

Figure 2:
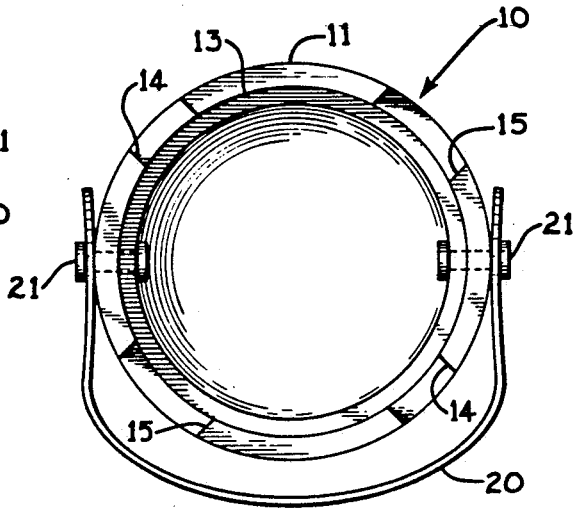
FIG. 2 is an end view of the embodiment shown in FIG. 1 without radiator cap and with flexible strap pivoted aside.

In the same embodiment a flexible strap 20 is pivotally mounted with fasteners 21 at diametrically opposed points on the exterior of body 11. Strap 20 could also be attached at a single point to body 11, or to points not diametrically opposed without departing from the scope of our invention. Flexible strap 20 may be any common rubberlike substance which maintains flexibility over a broad range of temperatures, which is impervious to heat within the expected range of automotive engine operating temperatures, and inert to automotive lubricants, solvents and coolants, and which is moderately compressible with good frictional properties. Flexible strap 20 has a length when pivotally attached to body 11 such that, when it is swung across the opening of body 11 and body 11 is inserted down over a lugless type radiator cap as shown in FIG. 1, there is enough slack in flexible strap 20 to permit a full insertion of body 11 over cap 5. This slack also facilitates swinging flexible strap 20 to the side as shown in FIG. 2, where remover 10 is to be employed on certain lug-type radiator caps. Fasteners 21 may be any screw, bolt, or rivet type of fastener. In a preferred embodiment, a screw-type fastener is employed.

To prevent the tool from going down too far over lugless radiator caps, an insert 13, which is comprised of a short section of pipe whose outside diameter is substantially the same as the inside diameter of body 11, is inserted up into body 11. Insert 13 also serves as a strengthening thickness for the application of fasteners 21.

In any case, gripping and holding a radiator cap as in FIGS. 1 and 3 is accomplished by swinging flexible strap 20 across the opening of body 11 and inserting body 11 down over radiator cap 5 until radiator cap 5 has snugly compressed flexible strap 20 against the inner surface of body 11 and/or insert 13 and then in the usual manner twisting, pressing and twisting the body 11 counterclockwise to remove the cap. In a preferred method of use, the remover 10 with its engaged cap 5 are held toward the body of the service person in order to direct any escaping hot gases or liquids away from the body of the service person at the moment that the pressure in the cooling system is released. The frictional engagement of cap within remover 10 is then maintained for ease of location and replacement of cap 5 at the conclusion of the radiator servicing operation.

Where lug-type radiator caps with lug sizes matching notch sizes are to be removed, or where a cap is merely to be loosened, flexible strap 20 is swung to the side of remover 10 as shown in FIG. 2, and the pair of notches corresponding to the size of the lugs on the radiator cap to be removed are placed down over the lugs on the radiator cap and the same twisting and pressing procedure as described above is employed together with the same safety venting procedure.

The embodiment depicted in the drawings will also fit and remove a number of oil filler caps. Suitably sized embodiments of the invention may also be employed to remove fuel filler neck caps, other oil filler neck caps and other closures in automotive systems which are either difficult to reach with fingers, or which present safety hazards such as high temperatures or the protruding edges of other components which present a cutting danger. Sizes of these other closures and caps vary, and embodiments sized for one application would not necessarily be universally employable.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

This invention will find use primarily as an automotive tool in the automotive service industry to assist service persons to remove hot radiator caps without hazard of cuts or burns to the service person. The device is quickly and easily constructed of durable materials and is inexpensive to manufacture. One embodiment of the device is fitted with a pair of notches, respectively ½" and 1 ⅜" in width, so as to accommodate the majority of radiator caps and their respective cap lugs. In addition the invention employs a resilient strip across the cap recess to tightly grip a radiator cap under the compressive force of compression of the resilient material against the inside surface of the relatively rigid walls of the cap remover. In operation the cap remover is engaged upon the cap, twisted and pressed for removal, and at the point of disengagement, tilted toward the body of the service person so that the escaping hot gases and liquids from the radiator are vented and shielded away from the service person. Ordinarily the cap is held in snug engagement with the cap remover until the cap is later reinstalled upon the radiator which assists in preventing lost caps. The invention represents a significant improvement over previous devices, and a single tool has virtually universal utility on radiator caps worldwide.

I claim:

1. An apparatus for removing a lugless radiator cap, the apparatus comprising: a cylindrical body having defined within one end of said body a recess adapted to receive said cap, the diameter of said recess being greater than the outer diameter of said cap, said body having attached to its exterior a strap of resilient material, such that said strap may be drawn across said recess, whereby said cap is frictionally engaged by said strap within said apparatus when said apparatus is placed over said cap.

2. The apparatus of claim 1 wherein said strap is resilient material is pivotally affixed to diametrically opposing points upon the exterior of said body, said strap of resilient material being long enough so that when so affixed, there is sufficient slack in said strap to permit it to be pushed inside of said recess by said cap.

3. The apparatus of claim 2 wherein said resilient material is a synthetic rubber.

4. In an apparatus for removing a radiator cap, said apparatus having a body, a recess for receiving said cap, and a first pair of diametrically opposed notches for engaging a pair of lugs protruding from an otherwise circular profile of said cap, the improvement comprising:

(a) a second pair of diametrically opposed notches so angularly displaced from said first pair of notches as to define two separate pairs of notches upon the periphery of said recess, wherein said second pair of notches have a width different from said first pair of notches;

(b) a resilient strap pivotally affixed at diametrically opposing points upon the exterior of said body such that said strap may be pivoted out of the way of said recess but which may be pivoted into place across said recess such that when said recess is fitted over said cap said resilient strap is pushed into said recess above said cap so that said cap compresses said strap against the walls of the recess and is thereby frictionally engaged by said body; and (c) said body is substantially cylindrical.

5. A method for removing a radiator cap comprising the steps of:

(a) placing upon said cap an apparatus having a recess adapted to fit over said cap;

(b) drawing a resilient strap across said recess and engaging said cap within said recess so as to wedge said cap tightly into said recess against the compressive force of said resilient material;

(c) engaging a pair of lugs of said cap within a pair of notches located upon the periphery of said recess of said apparatus;

(d) twisting and pushing in a counterclockwise fashion to disengage said cap from said radiator while tilting said apparatus toward a serviceperson so that said cap and apparatus act as deflecting screen for hot gas and water away from said serviceperson; and (e) removing said apparatus from said radiator with said cap engaged within said apparatus.

6. The method of claim 5 wherein said cap is reinstalled by reversing the steps of claim 5.

7. The method of claim 5 wherein said cap has no lugs and step (b) is therefore skipped.

8. The method of claim 5 wherein the longest diameter across said lugs of said cap is less than the diameter of said recess and step (b) is therefore skipped.

* * * * *